United States Patent [19]

Detter et al.

[11] Patent Number: 4,634,204

[45] Date of Patent: Jan. 6, 1987

[54] ELECTRICAL CONNECTOR WITH CONNECTOR POSITION ASSURANCE/ASSIST DEVICE

[75] Inventors: Gary C. Detter, Berlin Center; Samuel A. Norling, New Middletown; Janet S. Penney, Warren; Emil J. Tolnar, Jr., Cortland, all of Ohio

[73] Assignee: General Motors Corporation, Detroit, Mich.

[21] Appl. No.: 813,054

[22] Filed: Dec. 24, 1985

[51] Int. Cl.[4] ..... H01R 13/639; H01R 13/64

[52] U.S. Cl. ..... 339/91 R; 339/113 B

[58] Field of Search ..... 339/91 R, 113 R, 113 B

[56] References Cited

U.S. PATENT DOCUMENTS

| | | | |
|---|---|---|---|
| 3,501,736 | 3/1970 | Norris | 339/91 R |
| 3,611,261 | 10/1971 | Gregory | 339/91 R |
| 4,370,013 | 1/1983 | Niitsu et al. | 339/91 R |
| 4,433,888 | 2/1984 | Winger | 339/91 R |
| 4,452,501 | 6/1984 | Gladd et al. | 339/113 R |

FOREIGN PATENT DOCUMENTS

| | | | |
|---|---|---|---|
| 90502 | 10/1983 | European Pat. Off. | 339/91 R |
| 2447105 | 8/1980 | France | 339/91 R |

*Primary Examiner*—John McQuade

*Attorney, Agent, or Firm*—Arthur N. Krein

[57] ABSTRACT

A connector device for electric circuit terminals includes mating male and female connectors, one of which has resilient extended lock arm means that will lock behind a lock bar of a sized window of the other connector. When the two connectors are mated, a connector position assurance and assist device is inserted axially along a tracked slot and displaces the void between the sized window and under the extended lock arm means, with this device including releasable, resilient lock tab means to retain it in operative engagement with the connectors. If the connectors are only partly interconnected, upon initially insertion of the connector position assurance and assist device through the connector with the extended lock arm means it will assist the two connectors to become fully and rigidly mated, whereas if the device is initially inserted via the connector with the sized window it will refuse the further mating of the connectors and actually effect their separation whereby to prevent any type of connector partial engagement or intermittent electrical connection to occur.

3 Claims, 3 Drawing Figures

ELECTRICAL CONNECTOR WITH CONNECTOR POSITION ASSURANCE/ASSIST DEVICE

FIELD OF THE INVENTION

This invention relates generally to electrical connectors and, in particular, to an electrical connector device having a pair of dielectric connector bodies which are coupled and locked together by a deflectable lock member of one connector which snaps past and engages a lock member of the other connector body and with a connector position assurance/assist device fixed thereto.

DESCRIPTION OF THE PRIOR ART

An electrical connector of this general type is disclosed in U.S. Pat. No. 4,370,013 entitled "Connector Device for Electric Circuit", issued Jan. 25, 1983 to Niitsu et al. This patent is directed to a lock member which is designed to assure that a pair of male and female electrical connectors which are initially fully coupled and positively locked together by a manual assembly operation remain thus locked by means of the lock member. The lock member avoids the problem of the electrical connectors being decoupled by vibration or some other environmental influence during subsequent use and, in effect, is intended to prevent, without disclosure of the fact, the disassembly of the connectors.

SUMMARY OF THE INVENTION

The present invention relates to a connector device for electric circuits which includes a pair of mating or paired connectors with one of the connectors or first connector having an extended locking arm that is adapted to lock into a sized window on the other or second connector and a connector position assurance and assist device, hereinafter referred to as a CPA device, that is axially guided in a track slot in the first connector so as to extend into and displace the void in the sized window beneath the extended locking arm, the CPA device also including a pair of opposed side locking tabs each of which will abut against opposed surfaces of the mated connectors to effect locking engagement of the CPA device relative to the mated connectors.

It is therefore a primary object of this invention to provide an improved paired electrical connector lock arrangement with a connector position assurance and assist device that assures proper electrical mating and return of a pair of electrical connectors while still permitting disconnection thereof for repair of the electric circuit, if required.

Another object of this invention is to provide an improved paired electrical connector device wherein a first connector is provided with an extended locking arm adapted to lock into a sized window on a second connector with a connector position assurance and assist device which if inserted through the first connector will assist, if necessary, and retain the extended locking arm in lock engagement in the window of the second connector and, if inserted through the second connector will retain the lock engagement of the extended locking arm in the window if the connectors are correctly mated but, if not correctly mated, will operate so as to refuse such improper mating and effect separation of the connectors so that an assembler will realize that the connectors had not been correctly mated.

For a better understanding of the invention as well as other objects and further features thereof, reference is had to the following detailed description of the invention to be read in connection with the accompanying drawings.

DESCRIPTION OF THE PREFERRED EMBODIMENT

Figure 1:
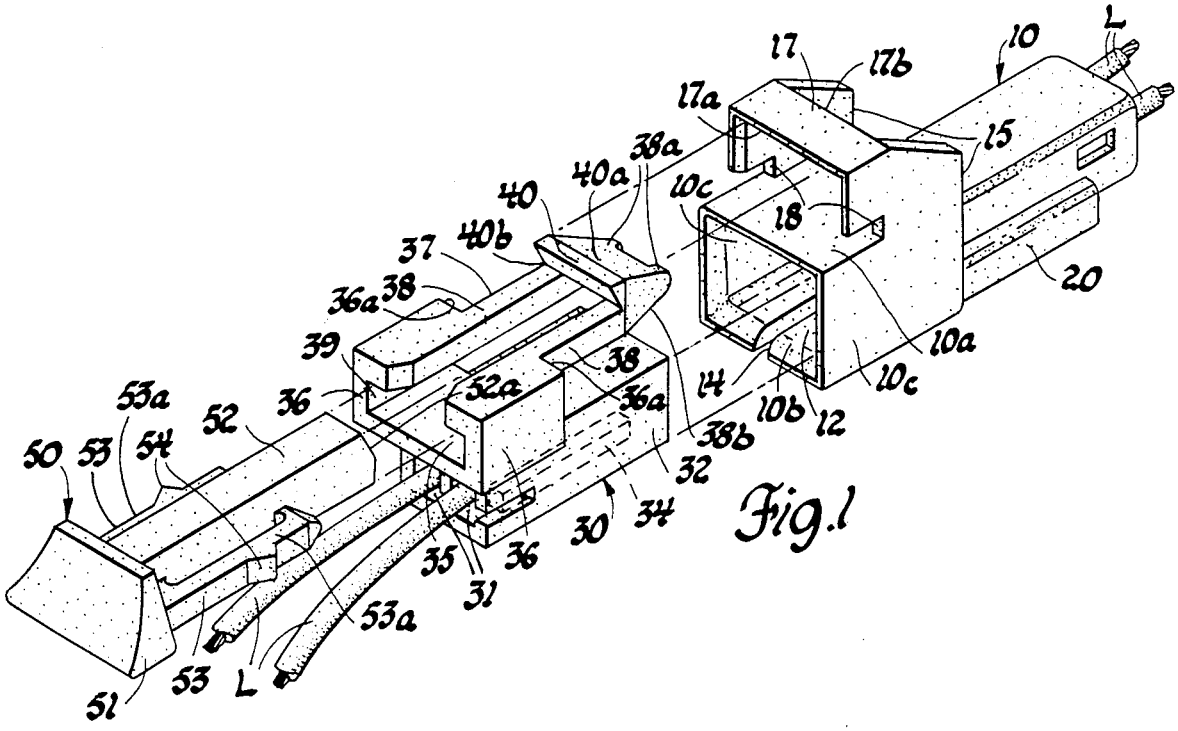
FIG. 1 is an exploded perspective view of a pair of electrical connectors with a lock arrangement for their interconnection and with a connector position assurance and assist device in accordance with the invention.

As best seen in FIG. 1, the electrical connector with connector position assurance/assist device, in accordance with the invention includes mating female and mating male connectors, each generally designated 10 and 30, respectively, and a connector position assurance/assist device, hereinafter referred to as a CPA device, generally designated 50. Each of these elements are made of a suitable electrical nonconductive or dielectric, plastic material and, preferably both the female connector 10 and male connector 30 are, for example, colored black while the CPA device 50 is made of a contrasting color, for example, such as red for a purpose to be described hereinafter.

Figure 3:
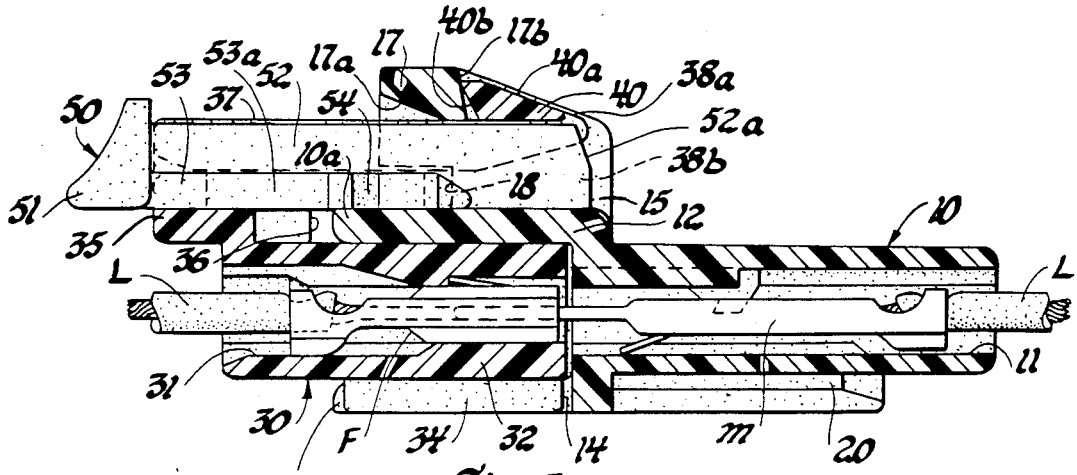

The male and female connectors 30 and 10, respectively, are each provided with one or more aligned through apertures 31 and 11, respectively, a pair of such apertures being used in the construction shown and having suitable conventional type female and male electrical terminals F and M, respectively, that are secured within the apertures in a known manner and each such terminal has an electrical lead L connected thereto in a manner whereby the leads extend outward from the outboard ends of the associate connectors, as best seen in FIG. 3.

Referring now to the female connector 10, it is provided at its inboard or mating end, the left end with reference to the Figures, with spaced apart upper and lower walls **10*a* and 10*b*, respectively, and side walls 10*c* to define a male plug receiving socket 12 of a size and shape to receive the mating male plug 32 on the inboard or mating end of the male connector 30. In addition, in the construction shown, the female connector 10 has a central, longitudinal slot 14 in the lower wall 10*b* defining a part of the socket that opens into the socket 12 so as to slidably receive a guide key 34 integral and depending from the lower wall surface of the male plug 32**.

In the construction illustrated, each of the side walls **10*c* defining in part the side walls of the socket 12, have upward stepped support extensions 15 that extend, upward, a predetermined distance from the top wall 10*a* of the socket end of this connector so as to support a cross-piece, lock bar 17 with these elements thus defining an open window of a predetermined height between the surface of the top wall 10*a* and the lower surface of the lock bar 17. Preferably, as best seen in FIG. 3, the inboard end of the lock bar 17 is provided with a downwardly inclined camming ramp surface 17*a* while its outboard end 17***b* is preferably inclined, at a predetermined angle, so as to define with the lower surface of the lock bar 17 an acute angle. As best seen in FIG. 1, each of the stepped support extensions 15 form, in effect, with the upper wall 10*a* a slot that terminates at an abutment shoulder or wall 18.

Referring now to the male connector 30, in the construction illustrated, it is provide at the outboard upper end, with reference to the Figures, of the plug 32 with an upper wall 35 of a height corresponding substantially to the thickness of the wall 10*a* defining the upper portion of the socket 12 of the female connector 10. Extending upward from the side edge of the upper wall 35 are a pair of opposed, spaced apart, side walls 36 which support one end of a flexible, extended locking arm means 37. The locking arm 37 includes a pair of stepped lock arms 38 and a lock tab or lock arm 40.

As shown, each of the side walls 36 has the wide end of a resilient, stepped lock arm 38 extending transversely inboard therefrom a predetermined distance whereby the inner side edges of the stepped lock arms 38, side walls 36 and upper wall 35 define an inverted T-shaped guide slot 39 that includes a lower tracked slot portion for a purpose to be described. The lock arms 38, at their inboard ends, support a cross-piece like, raised lock tab 40 that is provided at its upper leading or inboard, mating end with an inclined ramp surface 40*a* and at its opposite or outboard end with an abutment lock shoulder 40*b*, which as best seen in FIG. 3 is inclined upwardly in an outboard direction, so that when in a locked position relative to the lock bar 17, as shown in FIG. 3, it, in effect, makes substantially line contact therewith. In addition, the free end portions, that is, the right hand end with reference to FIGS. 1 and 3, of the stepped lock arms 38 are inclined at their upper surfaces with ramp surfaces 38*a* corresponding to the ramp surface 40*a* on the lock tab 40, and are provided with corresponding inclined lower ramp surfaces 38*b*.

Referring now to the connector position assurance and assist device or CPA device 50, it includes an enlarged push head 51 with a shank 52 extending centrally from the lower end thereof. As best seen in FIG. 3, the shank 52 is of a predetermined height so as to be slidably received through the open window defined between the upper surface of wall 10*a* and the lower surface of the lock bar 17 of the female connector 10 and is of a suitable width so as to be loosely received between the lock arms 38 of the male connector 30. Also as shown in FIGS. 1 and 3, the free end of the shank 52 is provided with an inclined upper ramp portion 52*a*.

Preferably as best seen in FIG. 3, the shank 52 is of a longitudinal extent such that, when the male and female connectors 30, 10, respectively, are properly mated and the CPA device 50 is positioned with its push head 51 in abutment against the outboard end of the male connector 30, the free end of the shank 52 will extend out beyond the lock tab 40 and be clearly visible to an assembler, to thus serve like a signal flag to indicate proper mating and locking together of the male and female connectors 30 and 10, respectively, and their effected fixed locked interconnection by the CPA device 50.

The CPA device 50 is also provided with U-shaped side guide and resilient lock tab means 53 located on the lower portion and on opposite sides of the shank 52 next adjacent to the push head 51 with the transverse width between the outer sides thereof being such whereby they will be slidably received through the lower tracked slot portion of the inverted T-slot in the male connector 30 and also between the support extensions 15 of the female connector 10.

Figure 2:
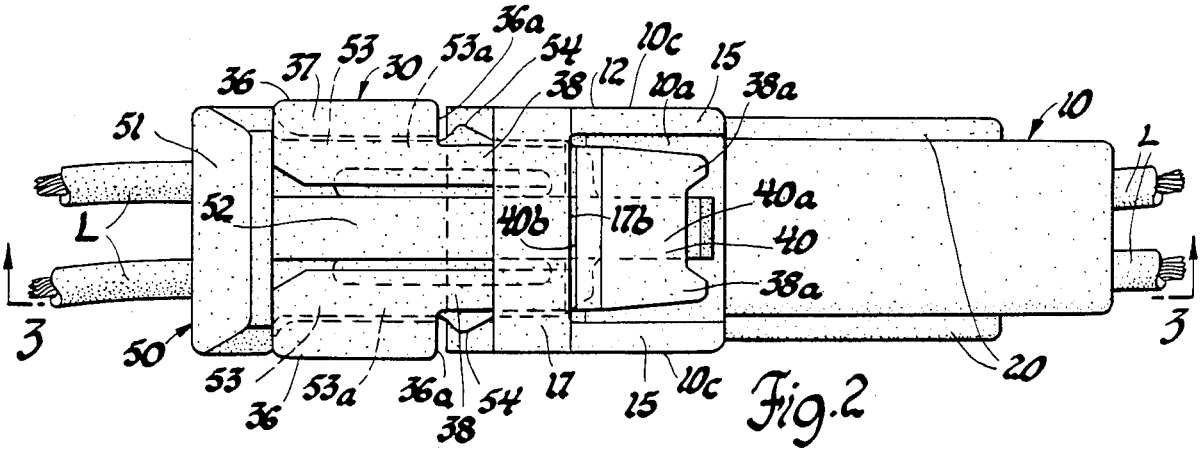
FIG. 2 is a top view of the pair of connectors and of the connector position assurance and assist device of FIG. 1 shown in their mated and locked assembled configuration; and, FIG. 3 is a cross-sectional view of the assembly of FIG. 2 taken along line 3—3 of FIG. 2.

Each of the side guide and resilient lock tab means 53 includes a resilient longitudinal finger portion 53*a* transversely spaced from the associate side wall of the shank 52 and each of these finger portions is provided with a tapered lock tab 54 extending outward therefrom and located longitudinally thereon in a location such that in the assembled position of the CPA device 50 relative to properly mated male and female connectors 30, 10, respectively, as shown in FIG. 2, each of the lock tabs 54 are positioned between associate opposed shoulders 36*a* and 18 on the male connector 30 and female connector 10, respectively. The lock tabs 54 are thus positioned so as to limit unintentional axial movement of the CPA device 50 after it is assembled, as illustrated.

However, as shown these lock tabs 54 are also positioned whereby they can be engaged by a suitable tool, such as a pair of needle nose pliers, so that upon the application of a suitable force on these lock tabs 54 in a direction toward each other so as to clear, for example, the shoulder 36*a* in the embodiment illustrated, as allowed by the resilient finger portions 53*a*, an axial outward pulling force applied on the push head 51 of the CPA device 50 can effect its removal from the mated male and female connectors 30, 10, respectively. This then would permit uncoupling of the male and female connectors 30, 10, respectively, if desired, by depressing the lock tab 40, downward with reference to FIG. 3, to a position under the bottom surface of the lock bar 17, after which opposed axial forces applied to the male and female connectors 30, 10, respectively, will effect their separation from each other.

As described hereinabove, it should now be apparent that a feature of this invention is to provide an electrical male connector 30 and female connector 10 with a lock device in the form of the CPA device 50, which will be operative so as to insure that male and female connectors 30, 10, respectively, can be properly mated so that they will have and sustain electrical interface across the connection. It is another feature of this invention that should the two paired connectors (male 30 and female 10), be partially connected, the CPA device 50 will: (a) assist the two electric male and female connectors to become fully and rigidly mated or (b) refuse the mating of the two electric male and female connectors by rejecting their axial movement in an opposite direction and thus prevent any type of connector partial engagement or intermittent electrical connection to occur, in a manner to be described hereinafter.

As described hereinabove, the basic construction of the electrical connectors and its related CPA device 50 is, in the construction shown, comprised of an extended locking arm means on the electric male connector 30 that is locked into a sized window of the other electric or female connector 10. When the two connectors 30, 10 are mated the CPA device 50 is preferably, as shown, inserted axially along a tracked slot defined by the inverted T-shaped slot in the male connector 30 and displaces the void between the sized window and under the extended lock tab 40. This CPA device 50 is initially pushed into this desired location resulting in the CPA device 50 either being locked into position, the position shown in FIGS. 2 and 3, or the CPA device 50 being prevented from going into the proper position because insufficient axial force was used to lock it in place. A repeat of the CPA device 50 insertion, with a high insertion force would then be required at this time to insure the CPA device 50 is locked into its proper position. Once locked in place the CPA device 50 displaces the void used by the extended lock arm means 37 during the mating and results in the two electric connectors being inseparable from any axial movement and consequently providing a fixed electrical interface, as best seen in FIG. 3, and, of course, the CPA device 50 is then also axially locked by the lock tabs 54 positioned between associate sets of shoulders 18 and 36*a*.

When the two electric connectors 10, 30 are only partially inserted into each other, that is, the extended lock arm means 37 extending only part way into the sized window and thus having the lock tab 40 displaced downward, and the CPA device 50 is then inserted axially through its tracked slot, the front inboard or free end of the shank 52 of the CPA device 50 will then abut against the outboard face of the extended lock tab 40 such that the CPA device 50 forces the lock tab 40 to continue axially forward until the electric connectors are completely mated together. At this time the extended lock tab 40 flexes up behind the cross bar 17 of the sized window and this in turn allows the CPA device 50 to be pushed into its final position, the position shown in FIGS. 2 and 3, and thus to establish an inseparable and fixed electrical connection.

Since a service person out in the field may not realize that the correct assembly should be such that the CPA device 50, in the construction illustrated is preferably inserted into the tracked slot at the outboard end of the male connector, the CPA device 50 and associate elements are sized and structured so as to also permit its insertion and assembly to the male and female connectors 30, 10, respectively, from the outboard end of the female connector 10, in a manner not shown, since from the structures shown in FIGS. 1–3, it will be clear that such assembly can be performed.

Thus it should be appreciated that the CPA device 50 can also be locked into position under the extended lock tab 40 from the opposite side of the sized window in the female connector 10 and in an axial motion opposite from the aforementioned method described and illustrated. When the two electric connectors 10 and 30 are fully mated, the CPA device 50 is inserted into its position from the opposite direction, that is, via the female connector 10 and the CPA device 50 will then displace the void used by the extended lock tab 40 during mating, resulting in a fixed electrical interface and inseparable electric connection.

When the two electric connectors 10 and 30 are only partially inserted into each other, that is, the extended lock tab 40 being part way into the sized window and thus displaced downward, and the CPA device 50 is then inserted from this opposite direction, the CPA device 50 will push against the front or free end of the extended lock tab 40 and cause the two electrical connectors 10 and 30 to be rejected from each other. This will insure that improper mating of the female and male connectors 10 and 30, respectively did not occur. Thus the assembler will be required to again effect the proper mated interconnection of the female connector 10 to the male connector.

Preferably, at least one of the connectors, the female connector 10 in the construction shown, is provided with spaced apart, opposed, blind slot means 20, open at the outboard end of this connector in position to receive, for example, the rectangular head of a push-in type fastener, not shown, whereby the connector assembly can be secured to a suitable support panel, not shown, in a vehicle in a manner well known in the art.

While the invention has been described with reference to the structures disclosed herein, it is not confined to the details set forth, and thus this application is intended to cover such modifications or changes as may come within the purposes of the improvement or the scope of the following claims.

The embodiments of the invention in which an exclusive property or privilege is claimed are defined as follows:

1. A connector device for electric circuit terminals including a matable female connector and male connector and a connector position assurance and assist device, said female connector having spaced apart a top wall, a bottom wall and side wall means defining a socket at its inboard mating end, and stepped support extensions extending upward from said side wall means relative to said top wall and a lock bar extending therebetween so as to define with said top wall open window means of a predetermined height, a portion of said stepped support extensions defining a first set of shoulders; said male connector having a plug means at its inboard mating end for engagement into said socket, said male connector further including a wall means upstanding from the outboard end of said plug means with resilient lock arm means extending therefrom so as to overlie said plug means in spaced relationship thereto and defining with said wall means an inverted T-shaped slot that includes a guide track next adjacent to said wall means, said resilient lock arm means including a lock arm at its free end adapted for locking engagement with said lock bar when said male and female connectors are fully mated, said wall means defining a second set of shoulders facing said inboard mating end of said male connector which are in spaced apart relationship to said first set of shoulders when said connectors are mated; said connector assurance and assist device including an enlarged push head with a shank extending therefrom of a predetermined height and axial extent slidably received by said slot whereby the free end of said shank is operative to effect and retain locking engagement of said lock arm with said lock bar and, said connector assurance and assist device further including side guide and resilient lock tab means, including outward extending tapered lock tabs, positioned on opposite sides of said plug means so as to be slidably received in said guide track whereby when said connector assurance and assist device is operatively connected to said male and female connectors, said tapered lock tabs are operatively positioned between said first and second sets of shoulders to effect axial retention of said connector assurance and assist device while being positioned so as to permit manual release of these tapered lock tabs to allow disassembly of said connector device.

2. A connector device in accordance with claim 1 wherein one of said walls defining said socket has a guide slot provided therein and wherein said plug means include a guide means slidably received in said guide slot to assist in effecting mating alignment of said plug means into said socket.

3. A connector device in accordance with claim 1 wherein said female connector and said male connector are of a first colored dielectric plastic material and wherein said connector position assurance and assist device is of a second contrasting colored dielectric plastic material whereby when all of said elements are properly operatively interconnected, opposite ends of said connector position assurance and assist device will be clearly visible to serve, in effect, as a signal flag, indicating a proper assembly of the elements.

* * * * *